US005779121A

United States Patent [19]

Capwell

[11] Patent Number: 5,779,121

[45] Date of Patent: Jul. 14, 1998

[54] POCKET CLOSURE AND COMPRESSION STRAP FOR A PACK

[75] Inventor: Linda Lee Capwell, Brackney, Pa.

[73] Assignee: Johnson Worldwide Associates, Inc., Racine, Wis.

[21] Appl. No.: 633,089

[22] Filed: Apr. 16, 1996

[51] Int. Cl.[6] ..... A45F 3/04

[52] U.S. Cl. ..... 224/655; 224/153; 224/652; 224/654; 224/659; 224/651; 224/235; 224/236

[58] Field of Search ..... 224/654, 655, 224/656, 657, 658, 659, 580, 209, 219, 222, 153, 651, 240, 235, 236, 652, 653, 628–636; 190/119; 383/84

[56] References Cited

U.S. PATENT DOCUMENTS

| | | | |
|---|---|---|---|
| D. 339,225 | 9/1993 | Zel | D3/32 |
| 990,837 | 5/1911 | Carlson | 224/633 |
| 1,505,661 | 8/1924 | Nelson | 224/635 |
| 2,407,787 | 9/1946 | Kernahan | 224/655 |
| 2,792,980 | 5/1957 | Brown | 224/235 |
| 3,563,431 | 2/1971 | Pletz | 224/6 |
| 3,648,907 | 3/1972 | Romney | 224/636 |
| 3,797,718 | 3/1974 | Plant | 224/25 A |
| 4,331,272 | 5/1982 | Ward | 224/154 |
| 4,491,258 | 1/1985 | Jones | 224/153 |
| 4,655,343 | 4/1987 | Lane et al. | 224/153 |
| 4,752,263 | 6/1988 | Pritchard et al. | 224/153 |
| 4,844,307 | 7/1989 | Rutledge | 224/211 |
| 5,114,059 | 5/1992 | Thatcher | 224/209 |
| 5,125,547 | 6/1992 | Russell | 224/215 |
| 5,570,824 | 11/1996 | Lyon et al. | 224/240 |

*Primary Examiner*—David J. Walczak
*Assistant Examiner*—Timothy L. Maust
*Attorney, Agent, or Firm*—Foley & Lardner

[57] ABSTRACT

A pocket closure and pack compression strap arrangement includes a pocket closure panel and a compression strap designed to extend across the internal storage volume of a pack. The pocket closure panel may be secured to a front panel of the pack or to a pocket panel forming an external pocket. The strap preferably includes a first portion secured to the pocket closure panel and a second portion secured to a back panel of the pack or to a portion of an internal or external frame. A latch or buckle allows the first and second portions of the strap to be secured to one another for closing the pocket and compressing a load packed in the internal storage space. The strap is drawn tight to maintain the pocket closed and the load compressed. The pocket closure panel is preferably secured to the pack along an attachment region that is wider than an attachment region along which the strap is secured to the pocket closure panel. Tensile forces resulting from compression of the load are thus transmitted to the pack over a region of the pack wider than the compression strap.

17 Claims, 2 Drawing Sheets

FIG. 1
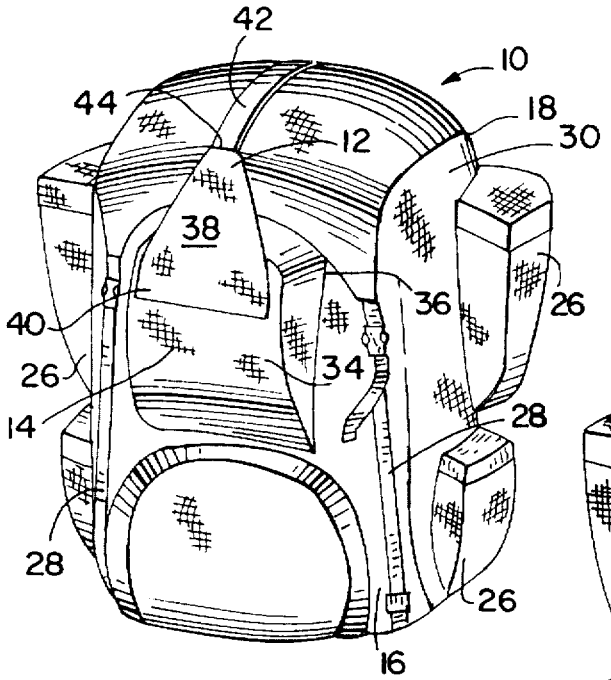
FIG. 2
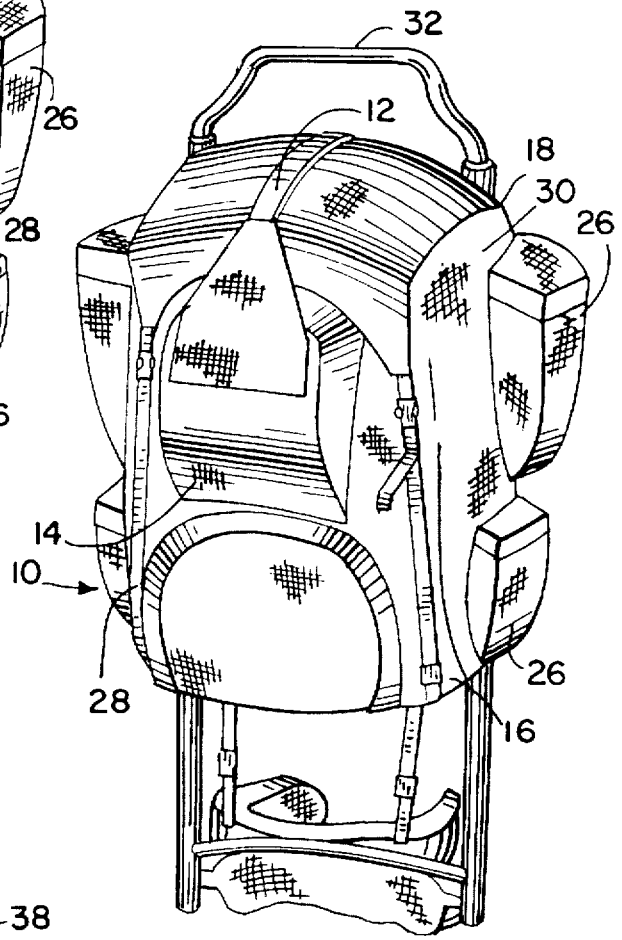
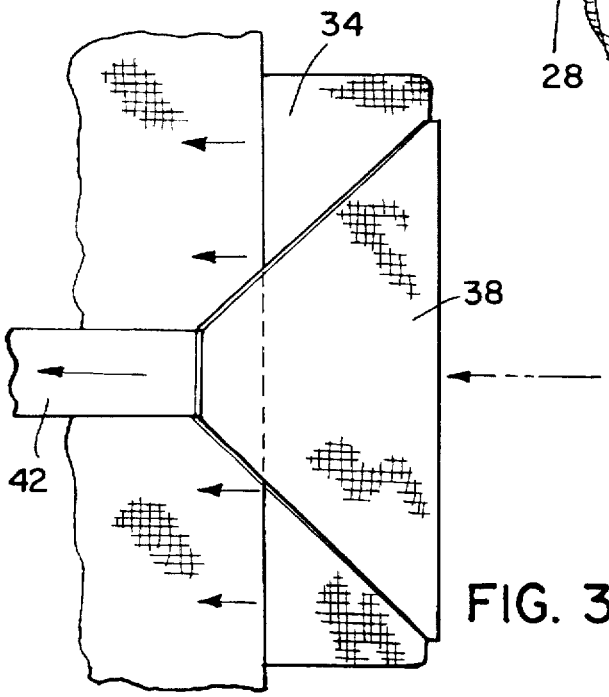
FIG. 3

POCKET CLOSURE AND COMPRESSION STRAP FOR A PACK

BACKGROUND OF THE INVENTION

The present invention relates generally to packs, such as backpacks for camping, hiking and trekking. In particular, the invention relates to an innovative pocket closure and compression strap arrangement for such packs that permits the user to close a storage pocket, such as an external pocket on a front panel of the pack, and to compress the internal volume of the pack with a single strap.

Packs, such as back packs, are well known and now include a myriad of features enhancing their convenience and functionality. Among the most useful features in such packs are secondary pockets apart from the primary internal storage volume which are accessible from outside the pack without requiring the user to open the internal storage volume. Such pockets are generally formed by sewing a fabric or leather sheet over a portion of the front or side panels of the pack. Zippers, snaps, ties or similar closure structures are typically provided on the pocket material for opening and closing the pocket.

Another feature that has become common, particularly on internal and external frame packs, is the use of compression straps or webbing to compress the contents of the pack once loaded. Such compression both reduces the volume of the pack and better secures the load to avoid shifting or bouncing as the pack is moved and transported. In known packs of this type, compression straps are generally secured to the front panel, such as in a seam between the front panel and a side panel, or may extend over an entire face of the pack, such as around the front panel. The straps typically include a latch or buckle for snapping portions of the straps together. Once joined, the portions of the straps are tensioned by pulling an end of one of the portions through the buckle to compress the load.

While such features have generally improved the convenience of packs, they are not without drawbacks. For example, sewing or otherwise affixing compression straps directly to the front or side panels of a pack tends to concentrate all tensile forces resulting from compression of the load in a relatively confined region surrounding the point of attachment of the straps. Over extended use, such loading may result in the tearing or otherwise weakening of the panel to which the straps are attached. Moreover, while various closure arrangements have been proposed for securing external pockets of packs, these have typically required separate and additional elements for each pocket, such as zippers, hook and loop closure pads and the like, adding to the complexity and cost of the packs.

There is a need, therefore, for an improved pack that alleviates these drawbacks in a design that is both affordable and uncomplicated to use. In particular, there is a need for an improved pack design that provides the convenience of external pockets while reducing the need for additional closure arrangements for each pocket. In addition, there is a need for a pack in which the internal storage volume can be compressed without exerting excessive loads on the panels comprising the pack.

SUMMARY OF THE INVENTION

The present invention features a novel strap arrangement designed to respond to these needs. In accordance with one aspect of the invention, a compression strap arrangement is provided for a pack of the type including first and second panels enclosing an internal storage volume. The arrangement comprises a pocket panel, a pocket closure panel and a compression strap. The pocket panel is affixed to the second panel of the pack. The pocket panel forms and at least partially encloses a storage pocket. The storage pocket has an opening for inserting articles into and removing articles from the pocket. The pocket closure panel is secured to the pocket panel for selectively closing the pocket. The compression strap is coupled to the pocket closure panel and extends to a portion of the pack across the internal storage volume. The compression strap is tensionable to maintain the pocket closure panel over the pocket opening and to compress the internal storage volume of the pack.

In accordance with another aspect of the invention, a compression strap arrangement for a pack includes a pocket panel and a compression strap. The pocket panel is affixed to the second panel of the pack and at least partially encloses a storage pocket. The storage pocket has an opening for inserting articles into and removing articles from the pocket. The compression strap is coupled to the pocket panel and extends to a portion of the pack across the internal storage volume. The compression strap is selectively tensionable to close the pocket opening and to compress the internal storage volume of the pack.

In accordance with still another aspect of the invention, a compression strap arrangement includes a load distribution panel and a compression strap. The load distribution panel is secured to the second panel of the pack along a first attachment region. The compression strap is secured to the load distribution panel along a second attachment region and extends between the load distribution panel and a portion of the pack across the internal storage volume. The compression strap is selectively tensionable to compress the internal storage volume. The load distribution panel distributes tensile forces resulting from compression of the internal storage volume substantially along the first attachment region. The first attachment region is preferably wider than the second attachment region, and the load distribution panel preferably closes a pocket that is accessible from the outside of the pack.

BRIEF DESCRIPTION OF THE DRAWINGS

The present invention will become more fully understood from the following detailed description, taken in conjunction with the accompanying drawings, wherein like reference numerals refer to like parts, in which:

FIG. 1 is a perspective view of a pack including a pocket closure and load compression strap arrangement;

FIG. 2 is a perspective view of an external frame pack incorporating an arrangement similar to that illustrated in FIG. 1;

FIG. 3 is a top view showing the load compression strap arrangement illustrated in FIG. 1;

DESCRIPTION OF THE PREFERRED EMBODIMENTS

Figure 4:
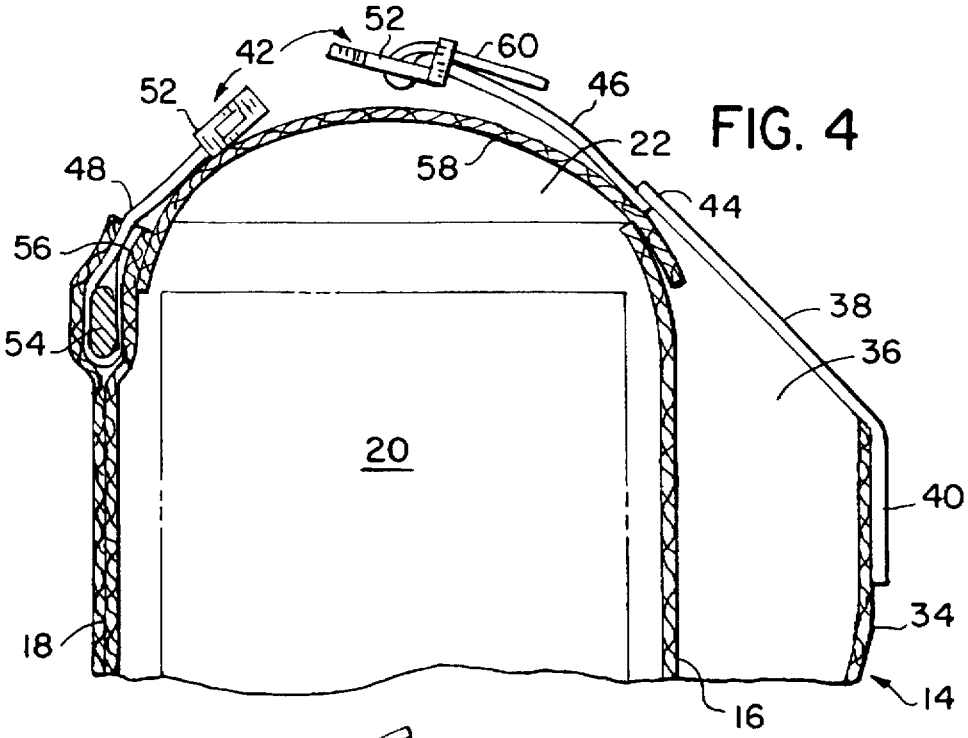
FIG. 4 is a partial sectional view of the pack of FIG. 1, illustrating the various parts of the compression strap arrangement in which a portion of the compression strap is secured to an internal frame element, showing a condition wherein the latch or buckle is not snapped or coupled together.

Turning now to the drawings and referring to FIG. 1, a back pack 10 is illustrated as including a compression strap arrangement 12 for covering a pocket 14 and for compressing a load within the pack. Pack 10 includes a front panel 16 (see FIG. 4) joined to a back panel 18 to enclose an internal storage volume 20 accessible through an upper end 22. Pack 10 also includes shoulder straps (not shown), which may be of conventional design, for supporting and carrying pack 10. Moreover, pack 10 may include various additional pockets 26 of known design, accessible from outside the pack, as well as conventional compression straps 28 extending across or between front and back panels 16 and 18. Front and back panels 16 and 18 may be single or multiple ply materials, such as fabric, leather, plastic or composite materials, or a combination of such materials, and may be sewn, glued, riveted or otherwise joined to form pack 10. In addition, side panels 30 may be provided between front and back panels 16 and 18 for increasing the size of internal storage volume 20. Moreover, pack 10 may include an internal frame, shown partially in FIG. 4, made of metal or plastic reinforcing and stiffening battens in a manner generally known in the art, or may include a metal or plastic external frame 32 as illustrated in FIG. 2. Such internal and external frames are typically positioned adjacent to back panel 18, and may be removably or permanently attached to pack 10.

In the embodiment illustrated in FIG. 1, pocket 14 is formed from a pocket panel 34 sewn to front panel 16 to partially enclose pocket 14 between front panel 16 and pocket panel 34. An opening 36 of pocket 14 is selectively opened and closed (i.e., covered) by a pocket closure panel 38. Pocket closure panel 38 is sewn to pocket panel 34 along an attachment region 40. Pocket 14 may alternatively be formed by one or more pocket panels (not shown) sewn or otherwise secured within pack 10, such as to an internal surface of front panel 16. In addition, pocket panel 34 may comprise side or bottom gussets (not shown) forming an expanded pocket storage volume in a manner known in the art. Pocket panel 34 and pocket closure panel 38 may be single or multiple ply panels of fabric, leather, plastic or composite materials.

Compression strap arrangement 12 includes a compression strap 42 secured to pocket closure panel 38 for spanning from panel 38 across internal storage volume 20. Compression strap 42 is preferably made of a synthetic fiber webbing and is sewn or otherwise permanently attached to pocket closure panel 38 along an attachment region 44. As illustrated in FIGS. 1 and 2, pocket closure panel 38 is preferably triangular or trapezoidal in shape, whereby attachment region 40 along which pocket closure panel 38 is secured to pocket panel 34 is substantially wider than attachment region 44. While strap 42 may be a single length of webbing, in an examplary embodiment described in greater detail below and illustrated in FIG. 4, strap 42 includes a first portion 46 permanently secured to pocket closure panel 38 and a second portion 48 permanently secured to back panel 18 or to a portion of an internal or external frame.

Figure 5:
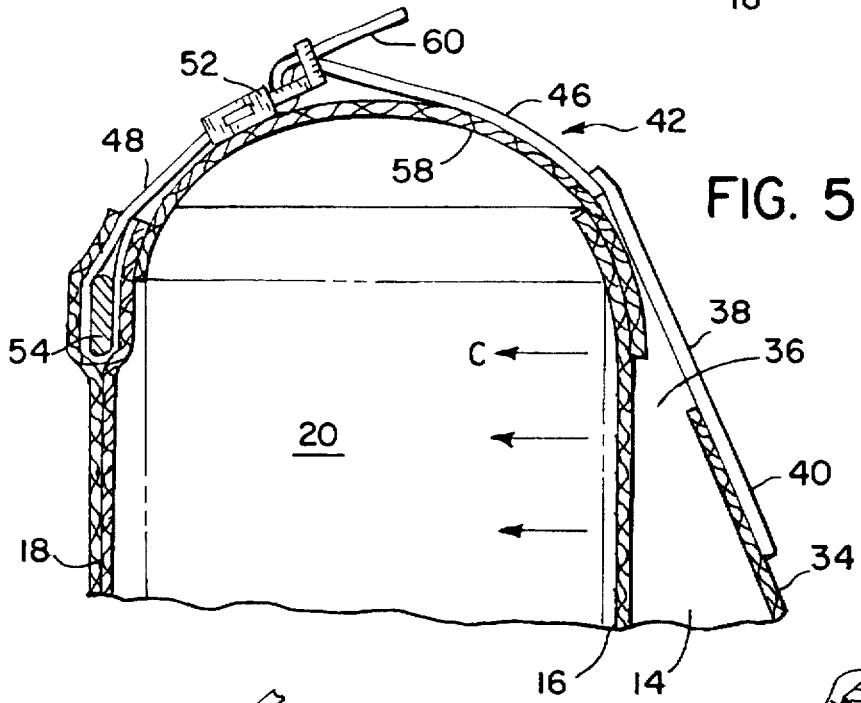
FIG. 5 is a partial sectional view of the pack of FIG. 1, showing a condition wherein the latch or buckle is snapped or coupled together and the compression strap is tensioned to close an external pocket and compress the load stored in the pack.

Preferred alternative embodiments for compression strap arrangement 12 are illustrated in FIGS. 4, 5, 6 and 7. As mentioned above, pocket panel 34 is secured to front panel 16 of pack 10, such as by stitching, to partially enclose pocket 14. Closure panel 38 is secured to pocket panel 34 by similar stitching along attachment region 40. Compression strap 42 is, in turn, secured to closure panel 38 along region 44. In the embodiment shown in FIG. 4, compression strap 42 includes a first portion 46 permanently attached to closure panel 38 and a second portion 48 permanently secured to a batten 54 or a similar element of an internal or external frame. In the presently preferred embodiment shown in FIG. 7, second portion 48 of strap 42 is secured to back panel 18 by stitching along an attachment region 56. In the embodiment shown in FIG. 4, second portion 48 is looped around a batten 54 or a similar horizontal frame member that is part of an internal frame provided between plies of back panel 16. A two-part latch or buckle 52 is provided on free ends of first and second portions 46 and 48 to permit portions 46 and 48 to be selectively snapped or coupled to one another across internal storage volume 20. FIG. 5 shows the parts of latch or buckle 52 snapped or coupled together. Buckle 52, which may be of a type generally known in the art, permits one or both portions 46 and 48 of strap 42 to be slidingly adjusted to tighten and tension strap 42 and compress volume 20 as indicated by arrows C in FIG. 5.

Figure 6:
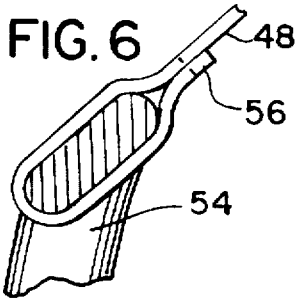
FIG. 6 is a partial sectional view of a variant of the arrangement of FIG. 2, wherein a portion of the compression strap is secured to an external frame element.
Figure 7:
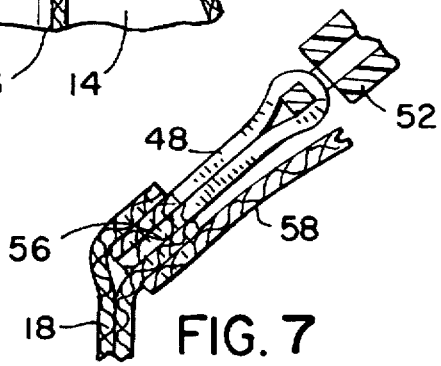
FIG. 7 is a partial sectional view of a variant of the arrangement of FIG. 1, wherein a portion of the compression strap is affixed directly to a back panel of the pack.

In the embodiment shown in FIG. 6, batten 54 is part of an external frame to which the second portion 48 of strap 42 is secured, such as by looping second portion 48 around batten 54 and securing strap 42 to itself along a region 56, such as by stitching. As mentioned above, in the compression strap arrangement shown in FIG. 7, the second portion 48 of compression strap 42 is affixed directly to back panel 18 of pack 10. Strap 42 is sewn or otherwise permanently attached to front panel 16 along an attachment region 56, such as between fabric plies. This variant may be used in a pack with an internal or external frame as well as a frameless pack.

In use, pack 10 is filled and packed, and upper end 22 is closed or covered by a spindrift (not shown) and an upper flap 58 or the like, in a conventional manner, as best illustrated in FIG. 4. Pocket 14 may then be packed without requiring internal storage volume 20 to be reopened. Pocket 14 is closed by folding closure panel 38 over opening 36 of pocket 14 and buckle 52 is coupled to join first and second portions 46 and 48 of strap 42 over internal storage volume 20. A free end 60 of first portion 46 is then pulled to tension strap 42. Buckle 52 preferably maintains portion 46 tensioned via friction in a manner well known in the art. Pocket 14 may be opened by releasing tension from strap 42 and unfastening buckle 52 to release first and second portions 46 and 48 from one another. It should be noted that, alternatively, flap 58 may be disposed to cover strap 42.

It will be noted that tensioning strap 42 secures closure panel 38 over pocket 14 to maintain pocket 14 closed, and also compresses the load within volume 20. As illustrated, closure panel 38 preferably has a trapezoidal shape, with a broad end at attachment region 40 and a narrower end at attachment region 44. It should also be noted that, by virtue of this preferred shape of closure panel 38, tensile forces resulting from tightening strap 42 are transmitted to front panel 16 over broad attachment region 40, thereby distributing tensile loading over a region of pack 10 substantially wider than strap 42 and reducing point-type loading that can lead to tearing in conventional compression strap arrangements.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims. For example, although in the preferred embodiments described above pocket 14 is provided on front panel 16, such pockets may be provided in a similar manner on other panels of pack 10, such as on side panels 30. Moreover, while pocket closure panel 38 and pocket panel 34 have been described as separate elements joined by stitching or the like, these elements may be formed as a single integral panel. Thus, compression strap 42 may be secured directly to pocket panel 34. In addition, the load distributing function of pocket closure panel 38 may be achieved by securing panel 38 directly to front panel 16, rather than to pocket panel 34.

I claim:

1. A compression strap arrangement for a pack of the type including front and back panels enclosing an internal storage volume, the arrangement comprising:

a pocket panel adapted to be affixed to the front panel of the pack, the pocket panel forming and at least partially enclosing a storage pocket, the storage pocket having an opening for inserting articles into and removing articles from the pocket;

a pocket closure panel secured to the pocket panel for selectively closing the pocket; and a compression strap coupled to the pocket closure panel and adapted to extend to a portion of the pack across the internal storage volume, the compression strap being adjustably tensionable to maintain the pocket closure panel over the pocket opening and adapted to compress the internal storage volume of the pack.

2. The compression strap arrangement of claim 1, wherein the pocket closure panel is secured to the pocket panel along a region wider than the compression strap, whereby tensile forces resulting from compression of the internal storage volume are distributed along the region.

3. The compression strap arrangement of claim 1, wherein the pocket panel is adapted to be secured to an external surface of the front panel of the pack.

4. The compression strap arrangement of claim 1, wherein the compression strap includes a first portion secured to the pocket closure panel and a second portion adapted to be secured to the back panel of the pack, the first and second portions being joinable via a latch or buckle.

5. The compression strap arrangement of claim 1, wherein the strap is configured to compress the internal storage volume in an upper region of the pack.

6. A pack comprising:

a front panel;

a back panel coupled to the front panel, the front and back panels enclosing an internal storage volume;

a pocket panel affixed to the front panel of the pack, the pocket panel at least partially enclosing a storage pocket, the storage pocket having an opening for inserting articles into and removing articles from the pocket; and a compression strap coupled to the pocket panel and extending to a portion of the pack across the internal storage volume, the compression strap being selectively tensionable to close the pocket opening and to compress the internal storage volume of the pack.

7. The pack of claim 6, wherein the pocket panel is secured to an external surface of the front panel of the pack.

8. The pack of claim 6, wherein the compression strap includes a first portion secured to the pocket panel and a second portion to the back panel of the pack, the first and second portions being joinable via a latch or buckle.

9. The pack of claim 6, further comprising a frame adjacent to the back panel.

10. The pack of claim 9, wherein the frame is an internal frame.

11. The pack of claim 9, wherein the compression strap includes a first portion secured to the pocket panel and a second portion secured to the frame, the first and second portions being joinable via a latch or buckle.

12. The pack of claim 6, wherein the strap is configured to compress the internal storage volume in an upper region of the pack.

13. A compression strap arrangement for a pack of the type including first and second panels enclosing an internal storage volume and a frame adjacent to the first panel, the arrangement comprising:

a pocket panel adapted to be affixed to the second panel of the pack, the pocket panel forming and at least partially enclosing a storage pocket, the storage pocket having an opening for inserting articles into and removing articles from the pocket;

a pocket closure panel secured to the pocket panel for selectively closing the pocket; and a compression strap coupled to the pocket closure panel and adapted to extend to a portion of the pack across the internal storage volume, the compression strap including a first portion secured to the pocket closure panel and a second portion adapted to be secured to the frame, the first and second portions being joinable via a latch or buckle, the compression strap being adjustably tensionable to maintain the pocket closure panel over the pocket opening and adapted to compress the internal storage volume of the pack.

14. A pack comprising:

a front panel;

a back panel coupled to the front panel, the front and back panels enclosing an internal storage volume;

a frame adjacent to the back panel;

a compression strap being selectively tensionable to compress the internal storage volume and having a first portion secured to the front panel and a second portion secured to the frame;

wherein the first portion partially extends over the internal storage volume; and said first and second portions are joinable via a latch or buckle.

15. The pack of claim 14, wherein the front panel further includes a pocket panel forming and at least partially enclosing a storage pocket.

16. The pack of claim 15, wherein the pocket panel is secured to an exterior surface of the front panel.

17. The pack of claim 16, wherein the first portion of the compression strap is coupled to the pocket panel, and the compression strap is selectively tensionable to close the pocket panel.

* * * * *